US005463786A

United States Patent [19]

Mangone et al.

[11] Patent Number: 5,463,786

[45] Date of Patent: Nov. 7, 1995

[54] WELDLESS GRATING FOR BRIDGE DECKS

[75] Inventors: Ronald W. Mangone, New Kensington; Dennis Imm, Vandergrift, both of Pa.

[73] Assignee: Grate-Lok Co., Inc., New Kensington, Pa.

[21] Appl. No.: 304,519

[22] Filed: Sep. 12, 1994

[51] Int. Cl.[6] ..... E04C 2/42; E01D 19/12

[52] U.S. Cl. ..... 14/73; 52/668; 404/70

[58] Field of Search ..... 14/73; 404/70, 404/134; 52/664, 667, 668, 669

[56] References Cited

U.S. PATENT DOCUMENTS 2,128,753 8/1938 Lienhard .
2,190,214 2/1940 Nagin .
2,645,985 7/1953 Beebe et al. .
2,834,267 5/1958 Beebe .
3,260,023 7/1966 Nagin .
4,452,025 6/1984 Lew .
4,780,021 10/1988 Bettigole .
4,865,486 9/1989 Bettigole .
4,928,471 5/1990 Bartley ..... 52/664

*Primary Examiner*—Ramon S. Britts
*Assistant Examiner*—James A. Lisehora
*Attorney, Agent, or Firm*—Andrew Alexander

[57] ABSTRACT

A weldless grating comprising a plurality of longitudinal load bearing members, secondary load bearing members and/or tertiary load bearing members having a rod extending through the tertiary load bearing members and primary load bearing members locking the tertiary load bearing members in slots in the secondary load bearing members and locking the secondary load bearing members in slots in the primary load bearing members to form the grating.

20 Claims, 6 Drawing Sheets

WELDLESS GRATING FOR BRIDGE DECKS

BACKGROUND OF THE INVENTION

This invention relates to grids or gratings useful for open or filled bridge decks, walkways, drain gratings and the like and more particularly, this invention relates to grids or gratings that are constructed and held together without welding.

In making prior gratings for bridge decks, whether the deck is open or filled with concrete, a certain amount of welding is performed to hold or bind the individual components together. That is, if the grid is used for open grating or open bridge deck, the main load-bearing members, secondary load-bearing members and tertiary load-bearing members are welded together, usually by puddle welding, to hold the members together and give the deck or grating strength. Even if the grid or deck is to be encased in concrete, still some welding is required to hold the assembly in a rigid configuration until the concrete hardens. If only minimal welding is performed, then the deck or grid work when encased in concrete has a decreased level of strength. Thus, for peak bridge strength, the various components of the grating or bridge deck must be fastened together to perform as a unit.

Various deck or grating systems have been proposed in the art, and the members comprising the grating deck are welded together. For example, U.S. Pat. No. 3,260,023 discloses a bridge floor and surfacing component. The bridge floor comprises parallel bearer bars and cross bars. The cross bars are pressure welded into the tops of the bearer bars.

U.S. Pat. No. 4,865,586 discloses a method of assembling a steel grid and concrete deck wherein the primary load-bearing bars are formed with openings to receive slotted secondary load-bearing bars that are passed through the primary load-bearing bars. However, the patent discloses that tack welds are used to temporarily hold the grating in its desired configuration. A concrete component encases at least the top surface of the grating base member and secures the elements of the grating base member together.

U.S. Pat. No. 2,128,753 discloses a steel floor construction having a series of parallel main bars in spaced relationship. Each of the main bars is provided with a plurality of rectangular-shaped openings. The openings are designed to permit the insertion thereon and the positioning of two cross bars. A third set of bar is placed in slots in the cross bars. After the members are assembled, the entire construction may be welded together to maintain the different parts in position.

U.S. Pat. No. 2,190,214 discloses a grating wherein a desired number of parallel spaced apart main bearer bars with intermediate bearer bars of less depth are placed between the main bearer bars. The main bearer bars and intermediate bearer bars are connected at their tops by cross bars secured thereto by electric pressure welding. Carrier bars which pass through slots in the main bearer bars are welded to the intermediate bearer bars. Also, carrier bars are welded to the main bearer bars.

U.S. Pat. No. 2,645,985 discloses an open floor grating having a plurality of longitudinal primary members, a plurality of transverse secondary members welded to and extending between the primary members. A plurality of tertiary members are welded to the secondary members. A rod is inserted through holes in the webs of the primary members and welded thereto.

U.S. Pat. No. 2,834,267 discloses a grating comprised of a plurality of spaced parallel main longitudinal bars and a plurality of spaced parallel lacing bars and tertiary longitudinal bars intermediate the main bars. Bottom bars are inserted through holes in the webbing of the main bars. The intersection between the lacing bars and the tertiary bars are welded and the bottom bar is welded to the webbing of the main bar.

U.S. Pat. No. 4,452,025 discloses a self-interlocking grille consisting of a plurality of metallic or plastic strips or flats or bars with certain types of notches and holes disposed along the length of the strip or flats or bars in a regular interval, which are used together with a plurality of rods in assembling a variety of interlocking grills.

U.S. Pat. No. 4,780,021 discloses an exodermic deck conversion method for converting a conventional grid deck to an exodermic deck. Tertiary load-bearing bars are placed on top of the grating parallel to and between the primary load-bearing bars. A plurality of shear connectors, such as vertical studs, are welded or attached to the surface of the grating. It will be seen from the above that in gratings and bridge decks, usually some form of welding or cement is used to hold the assembly together.

However, welding gratings or deck structures have the problem that toxic fumes are released into the atmosphere causing health hazards to the welders and pollution of the environment. Welding of structures such as bridge decks results in curling or deforming of the deck as the welds cool. Thus, the design of the deck is complicated in that the curling or deforming must be accommodated in the design. Further, welding has the disadvantage that it is time consuming and often is the rate-determining step at which decks can be built. Welding also requires that the gratings or deck assemblies be maintained in jigs prior to starting the welding process. This is an additional, undesirable step in the process of making a bridge deck. Further, welds on bridge decks have the problem of cracking either with use or as the temperature cycles between winter and summer. It is desirable to rustproof gratings by galvanizing. However, because galvanizing is destroyed by welding, the welded grating or deck is often galvanized as a unit. However, this also results in temperature cyclization and warping of the bridge deck with the result that welds often break, detrimentally affecting the integrity of the deck.

Thus, it will be seen that there is a great need for an improved bridge deck or grating which will eliminate these problems and will provide for an improved deck or grating structure. The present invention provides such a structure.

SUMMARY OF THE INVENTION

It is an object of the present invention to provide an improved grating.

It is another object of the invention to provide a grating suitable for use on bridge decks.

It is a further object of the invention to provide an interlocking grating fastened together without welding.

Still, it is another object of the invention to provide an interlocking grating which may be used for open bridge decks or may be utilized with a concrete component that encases at least a top portion of the grating.

Yet, it is a further object of the invention to provide an interlocking grating for bridge decks and the like employing a primary load-bearing member and a secondary load-bearing member securely held together without welding.

And yet, it is an additional object of the invention to provide an interlocking grating for open or concrete encased bridge decks and the like employing a primary load-bearing member, a secondary member and a tertiary load-bearing member held together without welding.

These and other objects will become apparent from the drawings, specification and claims appended hereto.

In accordance with these objects, there is provided a grating comprising: (a) a plurality of longitudinally extending primary load bearing members having a top portion and a bottom portion having a plurality of spaced-apart slots therein extending downwardly through the top portion, the slots in each of said primary load bearing members being aligned with the slots in adjacent primary load bearing members; (b) a plurality of secondary load bearing members having a top portion, the secondary load bearing members positioned in the aligned slots in the primary load bearing members, the secondary load bearing members provided with slots extending downwardly through the top portion and located between said primary load bearing members; (c) a plurality of tertiary load bearing members positioned in the slots in the secondary load bearing members; and (d) a rod extending through said tertiary load bearing members and said primary load bearing members locking said tertiary load bearing members in the slots in said secondary load bearing members and locking said secondary load bearing members in the slots in said primary load bearing members to form said grating.

DETAILED DESCRIPTION OF PREFERRED EMBODIMENTS

Figure 1:
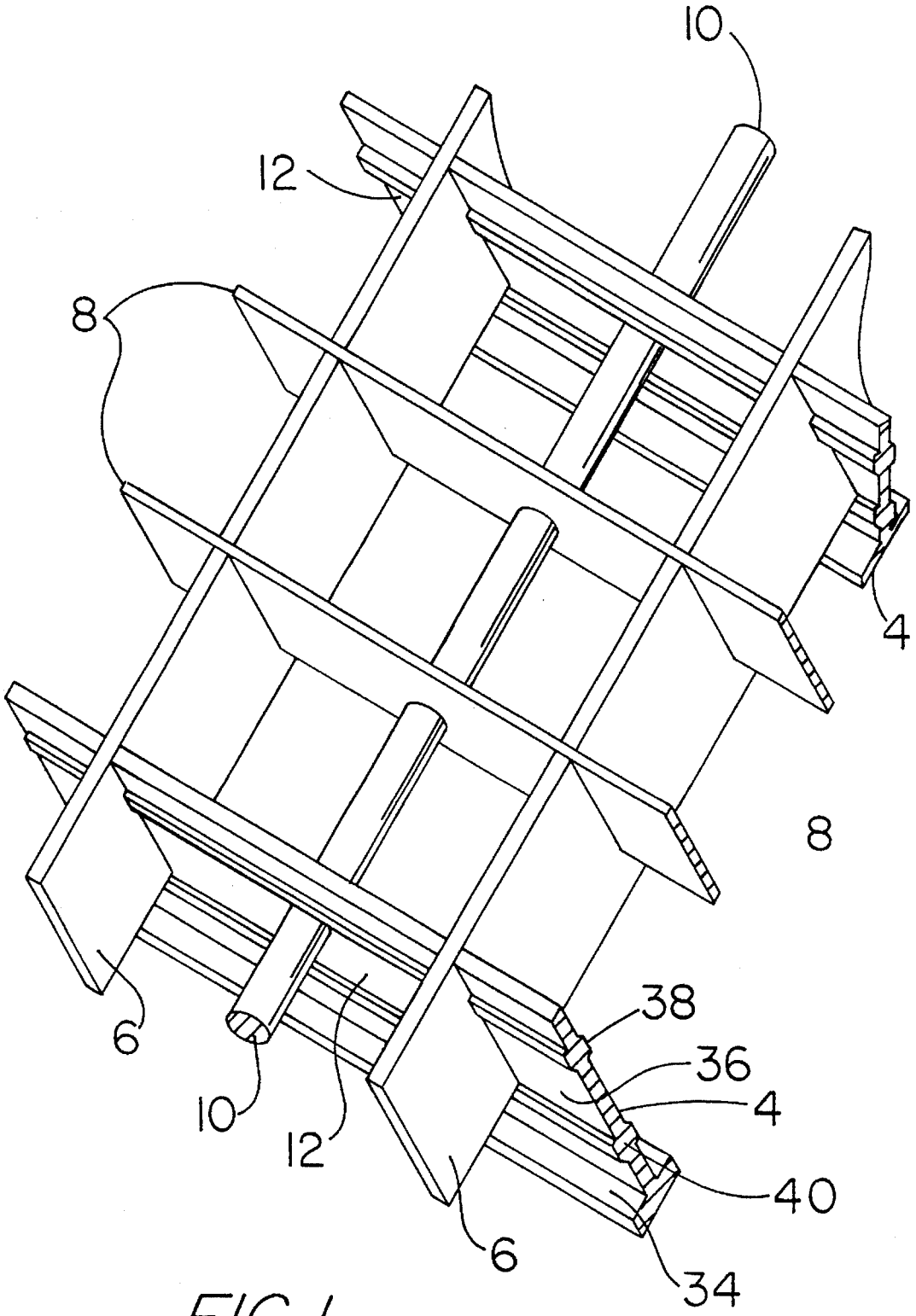
FIG. 1 is a perspective view of a grating in accordance with the invention utilizing deep web primary load-bearing members.

Referring now to FIG. 1, there is shown a grating in accordance with the present invention. Grating 2 is comprised of a plurality of primary load-bearing bars 4, a plurality of transverse secondary bars 6, a plurality of tertiary bars 8 shown running substantially parallel to the primary load-bearing bars 4. A rod 10 is shown laced through web 12 of primary load-bearing bar 4 and tertiary bars 8.

Figure 2:
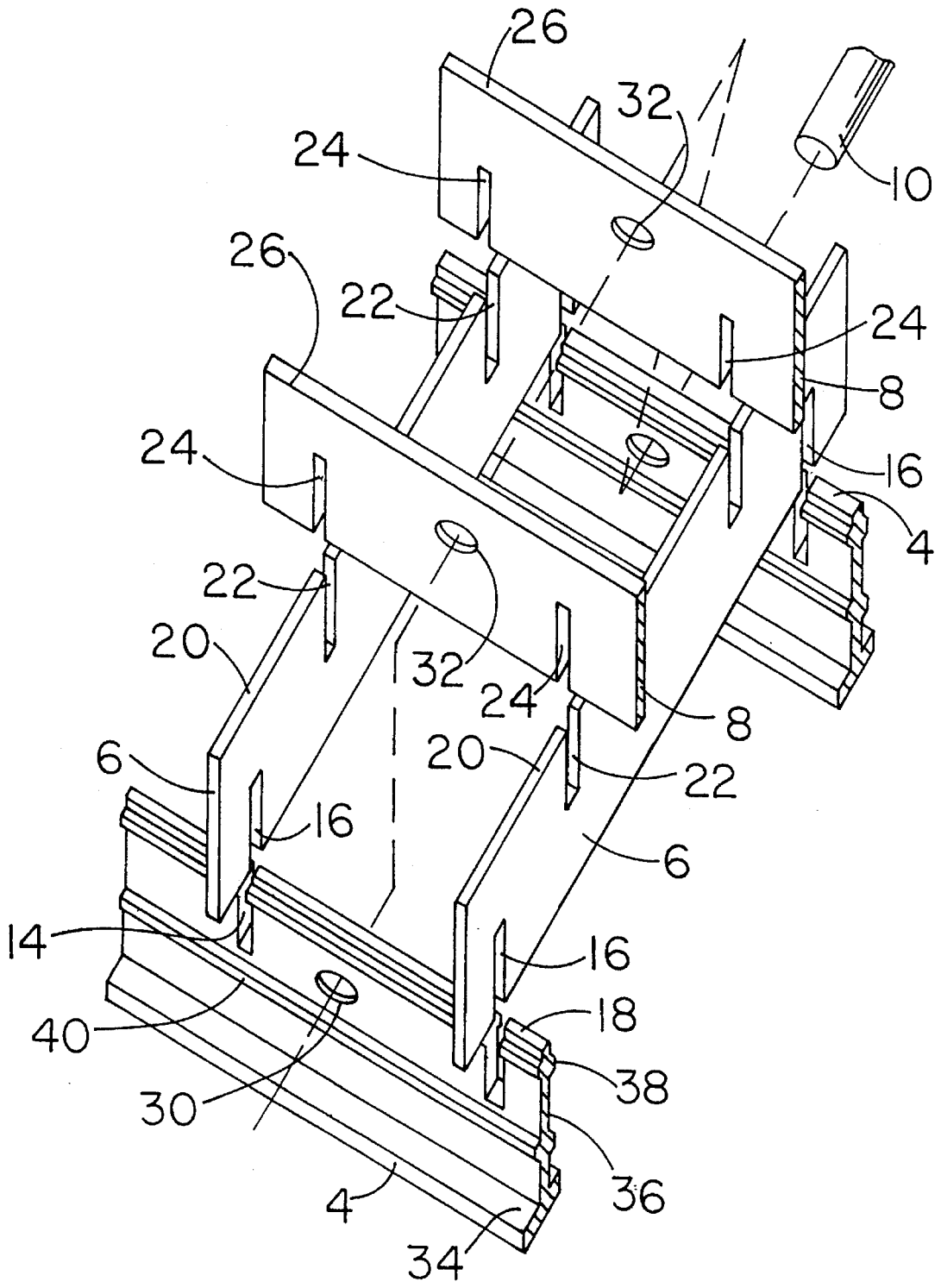
FIG. 2 is a perspective view showing the parts of the grating of FIG. 1 in unassembled relationship.

In FIG. 2, the primary load-bearing bars 4, transverse secondary bars 6, tertiary bars 8 and rod 10 are shown in an unassembled relationship. It will be seen that primary load-bearing bars 4 have slots 14 cut out to receive secondary bar 6. Slot 14 should be of a sufficient width to provide a snug fit for bar 6. Thus, each primary load-bearing bar 4 has a plurality of slots to receive each secondary load-bearing bar 6. Further, each secondary load-bearing bar 6 has a plurality of slots 16 that align with slots 14 in primary load-bearing bar 4 when assembled.

The depth of slots 14 and 16 in primary load-bearing bar 4 and secondary load-bearing bar 6 is normally about one-half the depth of secondary load-bearing bar 6 such that edges 18 and 20 when assembled form a planar surface. It should be understood that slots 14 and 16 may be cut to a depth to provide a raised edge 18 or 20, if necessary.

Further, it should be understood that slots 14 and 16 may be cut to accommodate each other. That is, if slot 14 is cut deeper than half of bar 6 then slot 16 may be cut shallower to provide for a planar surface. Secondary load-bearing bar 6 has a plurality of spaced-apart slots 22 on edge 20. In the embodiment shown in FIG. 2, two slots 22 are shown on secondary load-bearing bar 6 between primary load-bearing bar 4. Slots 22 are provided to accommodate tertiary load-bearing bars 8 which in the embodiment shown in FIG. 2 are mounted substantially parallel to primary load-bearing bar 4. It should be understood that one tertiary load-bearing bar 8 may be used between primary load-bearing bars 4. It will be appreciated that different combinations of bars may be used, all of which are encompassed within the scope of the invention.

Tertiary load-bearing bars 8 are provided with a plurality of slots 24 for alignment with slots 22. In assembly, slots 24 line up with slots 22 so as to provide a planar surface, if necessary. To provide a planar surface, slots 24 and 22 should have a depth equal to half the depth of tertiary load-bearing bar 8. However, as explained earlier, if it is desired to have tertiary load-bearing bar 8 project above edge 20, then slot 22 may be shallower. Also, as explained earlier, any combination of slot depths may be used to provide either a planar surface or a ridge or rough surface for traction. Also, in some cases, the secondary load bearing member may not be provided with slots 16, provided slot 14 is sufficiently deep to accept bar 6. Similarly, slots 24 may be eliminated if slots 22 are sufficiently deep in member 6.

Thus, it will be seen that in assembly, primary load-bearing bars 4 are first placed or fixed in position and then secondary load-bearing bars 6 are placed across primary load-bearing bars 4 with slots 14 and 16 in alignment. Thereafter, tertiary load-bearing bars 8 are placed across secondary load-bearing bars 6 with slots 22 and 24 being aligned.

For purposes of locking the assembly comprised of primary load-bearing bar 4, secondary load-bearing bars 6 and tertiary load-bearing bars 8, an aperture 30 is provided in primary load-bearing bars 4 between secondary load-bearing bars 6, the aperture being formed to have an axis substantially parallel to secondary load-bearing bars 6. Likewise, tertiary load-bearing bars 8 have apertures 32 formed so as to be in alignment with apertures 30 of primary load-bearing bars 4. Rod 10 then is fitted through a first aperture 30 in a first primary load-bearing bar 4, then through apertures 32 of tertiary load-bearing bar 8 and finally through a second aperture 30 in second primary load-bearing bar 4. In this assembly, end 11 of rod 10 may be bent, fitted with a pin or nut to ensure that it does not move. Thus, after having secured rod 10, primary load-bearing bars 4, secondary load-bearing bars 6 and tertiary load-bearing bars 8 are locked together to form a unit grating without the attendant problems inherent with welding. Further, because of the additional rod used, the strength of the grating structure is improved dramatically. It will be appreciated that one rod or more can be used between each set of secondary load-bearing bars 6. Further, fewer rods can be used. That is, in the present invention rods 10 can be selectively placed between secondary load-bearing bars 6. For example, in the present invention, high strength grating can be obtained when rods 10 are used between every other set of secondary load-bearing bars 6.

With respect to rod 10, it will be noted that a round bar has been illustrated. However, any cross-sectional configuration may be used.

In FIG. 1, primary load-bearing bar 4 is shown with a lower flange 34, a web portion 36, a bulbous portion 38, and a rib 40. However, primary load-bearing bars 4 can have other cross-sectional configurations that may be used. In the embodiment shown in FIG. 1, rib 40 and flange 34 provide for special features as explained herein.

Secondary load-bearing bars 6 can have a depth generally less than the depth of primary load-bearing bars 4, and tertiary load-bearing bars 8 can have a depth less than the depth of secondary load-bearing bars 6. Further, it should be noted that if secondary load-bearing bars 6 are sufficiently deep, then notch or slots 22 may be of sufficient depth to accommodate the full depth of the tertiary load-bearing bars 8 without slots 24 being provided in tertiary load-bearing bars 8. Rod 10 can provide sufficient resistance to sideways movement of tertiary load-bearing bars 8.

Figure 6:
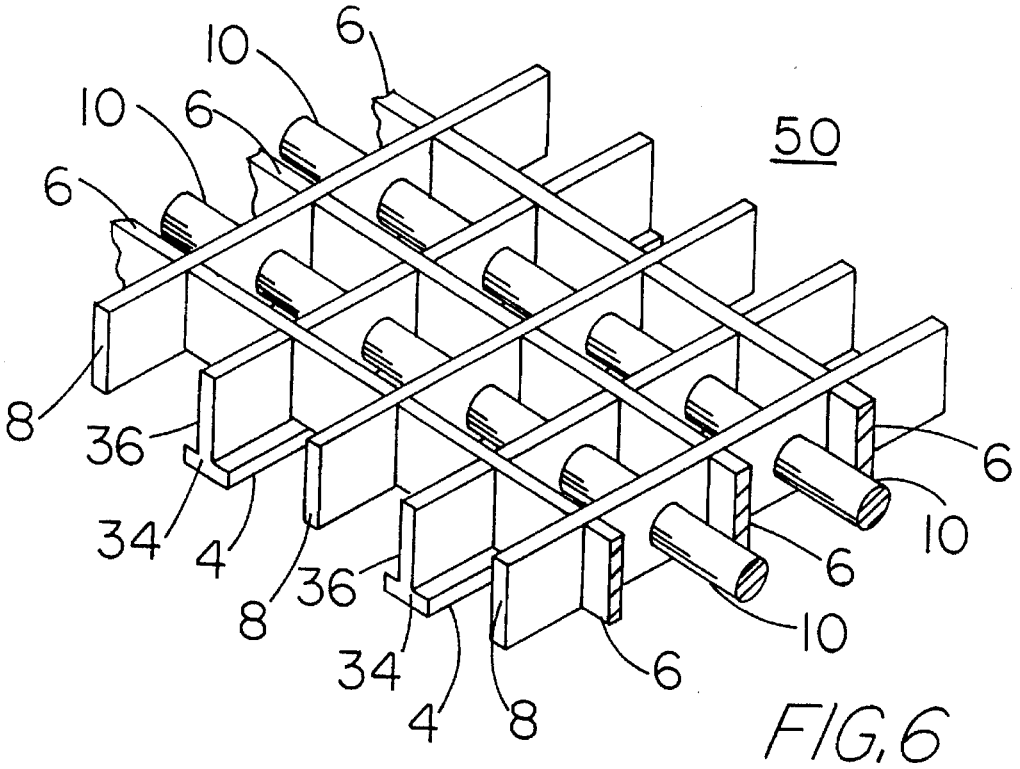
FIG. 6 is a perspective view of a grating utilizing an inverted T-shaped primary load-bearing member.

FIG. 6 illustrates a grating 50 in accordance with the invention having another configuration for primary load-bearing bars 4. In FIG. 6, like numbers have been used for like components. Primary load-bearing bars 4 are fabricated out of members that have a T-shaped configuration. Thus, primary load-bearing bars 4 have a bottom flange 34 and a generally planar web 36. Further, in FIG. 6, grating 50 is shown having primary load-bearing bars 4 having a web 36 substantially the same depth as secondary load-bearing bar 6. Also, tertiary load-bearing bars 8 have a depth substantially the same depth as the web in primary load-bearing bars 4 and substantially the same as secondary load-bearing bars 6. Primary load-bearing bars 4, secondary load-bearing bars 6 and tertiary load-bearing bars 8 can be assembled to provide a planar surface. Rod 10 is shown inserted parallel to secondary load-bearing bars 6 and through tertiary load-bearing bars 8 and web 36 of primary load-bearing bars 4 to provide a rigid unit grating by locking tertiary load-bearing bars 8 into secondary load-bearing bars 6. In the embodiment of the invention shown in FIG. 6, rods 10 are shown inserted between every other set of secondary load-bearing bars 6.

Figure 7:
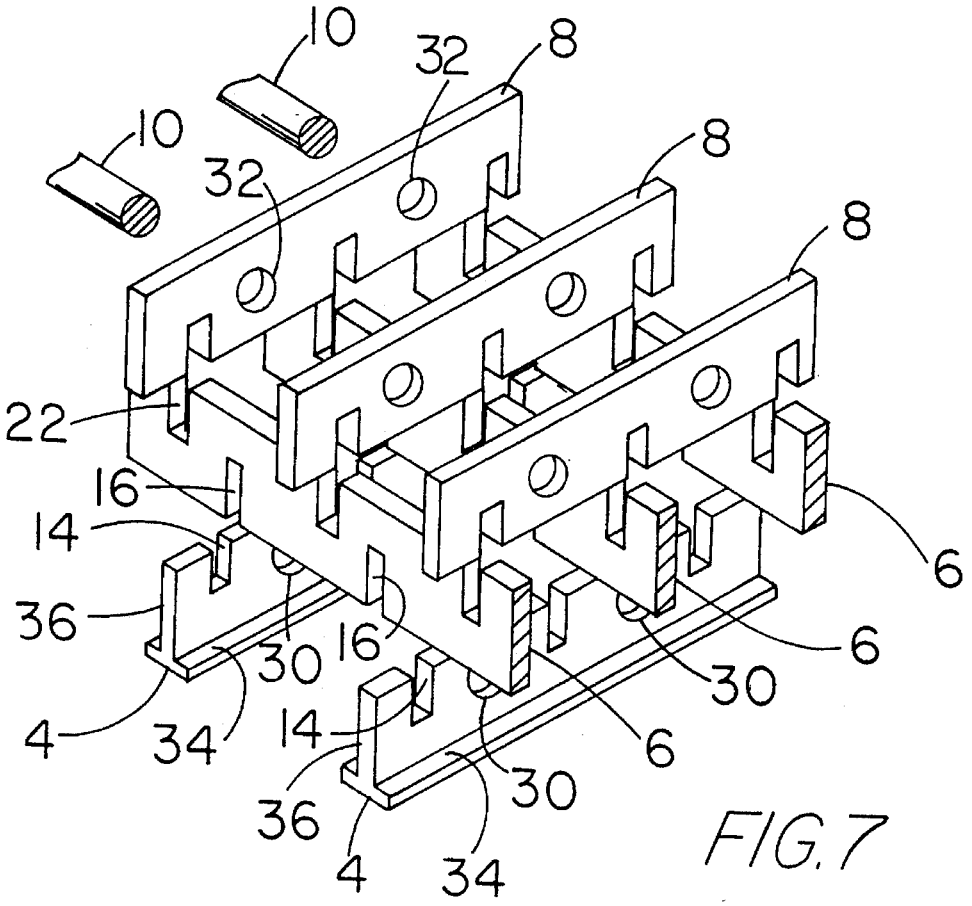
FIG. 7 is a perspective view showing the parts of the grating utilizing the inverted T-shaped web of FIG. 6 in unassembled relationship.

FIG. 7 is a perspective view showing the parts of the grating of FIG. 6 in unassembled relationship. Thus, there is shown primary load-bearing bars 4 having a plurality of slots 14 in alignment to receive secondary load-bearing bars 6. Secondary load-bearing bars 6 are provided with slots 16 to coincide with slots 14 when the grating is assembled. In addition, secondary load-bearing bars 6 are provided with a plurality of slots 22 in alignment as shown in FIG. 7. A plurality of tertiary load-bearing bars 8 are provided to fit into slots 22. Further, tertiary load-bearing bars 8 are provided with a plurality of slots adapted to coincide with slots 22. The depth of the slots can be as described earlier with respect to the embodiments described in FIGS. 1 and 2. While the gratings herein are shown with primary load-bearing bars 4 having a flange 34, it should be noted that such members may be flange free and all the members can be the same depth.

In the embodiment illustrated in FIGS. 6 and 7, web 36 is provided with apertures 30. Also, tertiary load-bearing bars 8 are provided with apertures 32. Apertures 30 and 32 are located in webs 36 and tertiary load-bearing bars 8 so that when the bars are assembled into a grating, apertures 30 and 32 are aligned to receive rods 10 thereby locking the bars or members in place to provide a grating. The grating may be used in an open configuration or it may be encased in concrete or it may be provided with an exodermic deck.

When the grating is used for open decks such as bridge decks, straight secondary load-bearing bars or straight tertiary load-bearing bars, particularly parallel to the direction of travel on the bridge deck, can result in vehicles being swayed back and forth in a direction transverse to the direction of travel. To avoid or minimize swaying, some of the bars, particularly the secondary load-bearing bars and/or the tertiary load-bearing bars are made to form an X-pattern or a zigzag pattern. In the present invention, either the secondary load-bearing bars or tertiary load-bearing bars can be formed to provide a zigzag pattern to minimize vehicle sway in the direction of travel. If tertiary load-bearing bars are formed to provide a zigzag pattern, then the slots 22 formed in top edges 20 of secondary load-bearing bars can be misaligned to accommodate the pattern formed in the tertiary load-bearing bars. If it is desired to mate the bars as noted previously, then the appropriate slots can be cut in the formed tertiary load-bearing bars. Also, apertures 30 and 32 are formed in web 36 and in the tertiary load-bearing bars. Aperture 30 in web 36 will be substantially perpendicular to the web. However, in the patterned tertiary load-bearing bars, the aperture will be formed entering the bar at an angle and thus can be more difficult to form. A rod 10 is then inserted through the aperture in web 36 and through the aperture in the patterned tertiary load-bearing bars to lock the components of the grating together to form a unitary grating having a pattern.

Figure 13:
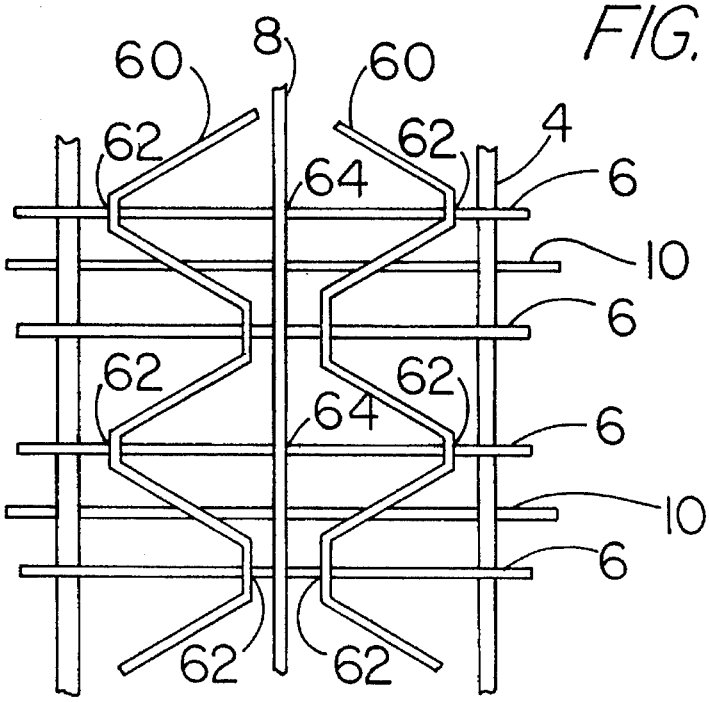
FIG. 13 is a top view showing a top view of a grating having a tertiary load bearing member having a zigzag configuration.

The grating employing zigzag tertiary load bearing bars 60 is shown in FIG. 13 which is a top view. Two primary load bearing bars 4 and four secondary load bearing bars 6 are also shown. Further, in the embodiment shown in FIG. 13, zigzag tertiary load bearing bars 60 are separated by a straight tertiary load bearing bar 8. Rods 10 are shown fastening or locking the grating together. That is, rod 10 is inserted through an aperture in primary load bearing bar 4, patterned tertiary load bearing bar 60, straight tertiary load bearing bar 8, patterned tertiary load bearing bar 60 and lastly primary load bearing bar 4. In this embodiment, slots are cut in the bars to provide a planar surface as explained earlier. In assembly of this embodiment, the webs of primary load bearing bars 4 are placed in a parallel and upright position, as shown, then secondary load bearing bars 6 are placed in matching slots in primary load bearing bars 4. Tertiary load bearing bars 60 are placed in matching slots in secondary load bearing bars 6. The slots are cut in secondary load bearing bars 6 at locations denoted by 62 for tertiary load bearing bars 60 and at 64 in tertiary load bearing bar 8. After rod 10 has been inserted, ends 11 may be fastened by any suitable means.

Figure 3:
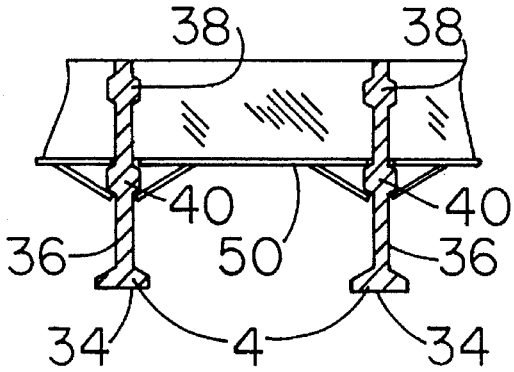
FIG. 3 is an end view along the primary load-bearing members showing a pan mounted on upper ribs of the primary load-bearing members to contain wet concrete.
Figure 10:
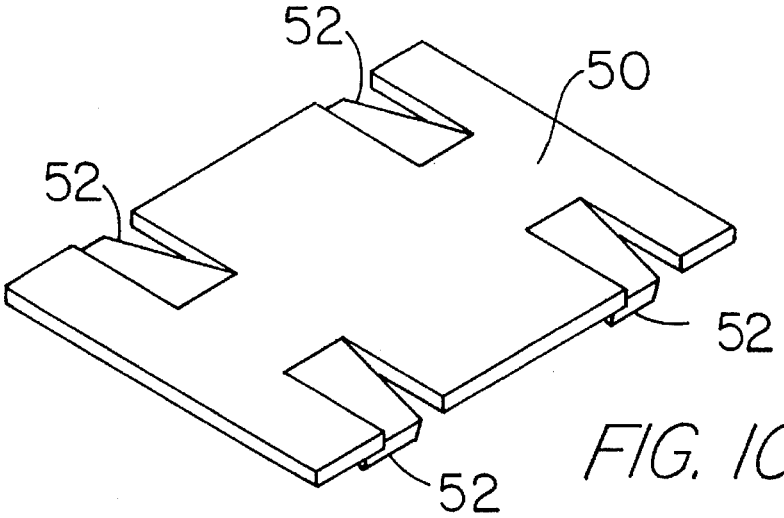
FIG. 10 is a perspective view of the pan of FIG. 4.
Figure 11:
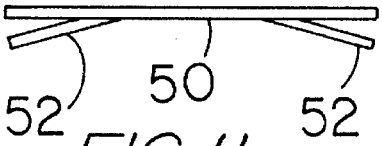
FIG. 11 is an end view of the pan of FIG. 3 showing tabs to lock the pan in place.

When it is desired to encase at least a portion of the grating in concrete, a pan or sheet member 50 is positioned between primary load-bearing bars 4 as shown in FIG. 3. Pan 50 is formed to extend the length of primary load-bearing bars 4 and to rest on ribs 40. Thus, pan 50 can be substantially flat as shown in FIGS. 10 and 11. Further, pan 50 can be provided with tabs 52 to grip the lower edge of rib 40. This configuration using tabs 52 locks the pan in place. Thus, the grating can be shipped to the job site without pans 50 moving or dropping out of the grating. It should be noted that welding pans 50 in place is undesirable because of warpage that occurs. The warpage results in uneven thickness of concrete and also in spaces between the rib and the pan which results in wet concrete seeping or dripping onto the surfaces below. The assembled grating in accordance with the invention has a rigid configuration without substantially any movement of the bars or members. Thus, for example, because primary load bearing bars do not move or wobble, the pans can be placed on or inserted between the primary load bearing bars prior to shipping.

Figure 4:
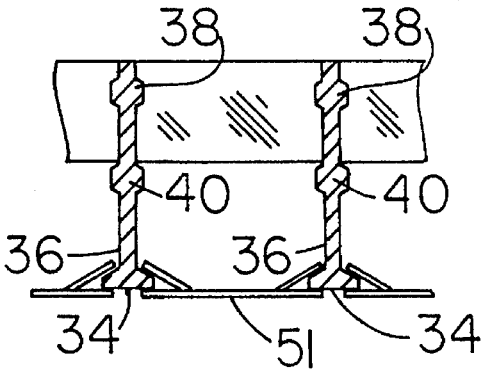
FIG. 4 is an end view along the primary load-bearing members showing a pan mounted on lower ribs of the primary load-bearing members to contain wet concrete.
Figure 12:
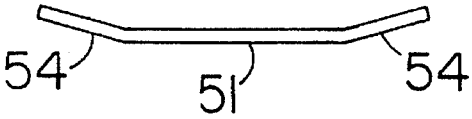
FIG. 12 is an end view of the pan of FIG. 4.

If it is desired to encase substantially the depth of the grating in concrete, a different shaped pan can be used, as shown in FIGS. 4 and 12. That is, pan 51 (see FIG. 12) can be provided with beveled edges 54 which are contoured to fit snugly with flange 34. Pan 51 can be lightly press fitted between primary load-bearing bars 4 to prevent movement, and additionally edges of pan 51 in contact with web 36 of primary load-bearing bars 4 can be serrated to ensure against slippage. The fitting of pan 51 as noted in FIG. 4 is also aesthetically pleasing when viewed from below. Instead of shaping pan 51 as shown in FIGS. 4 and 12, pan 51 can have a flat rectangular shape, preferably with serrated edges which rest on top of shoulders of flange 34.

Figure 5:
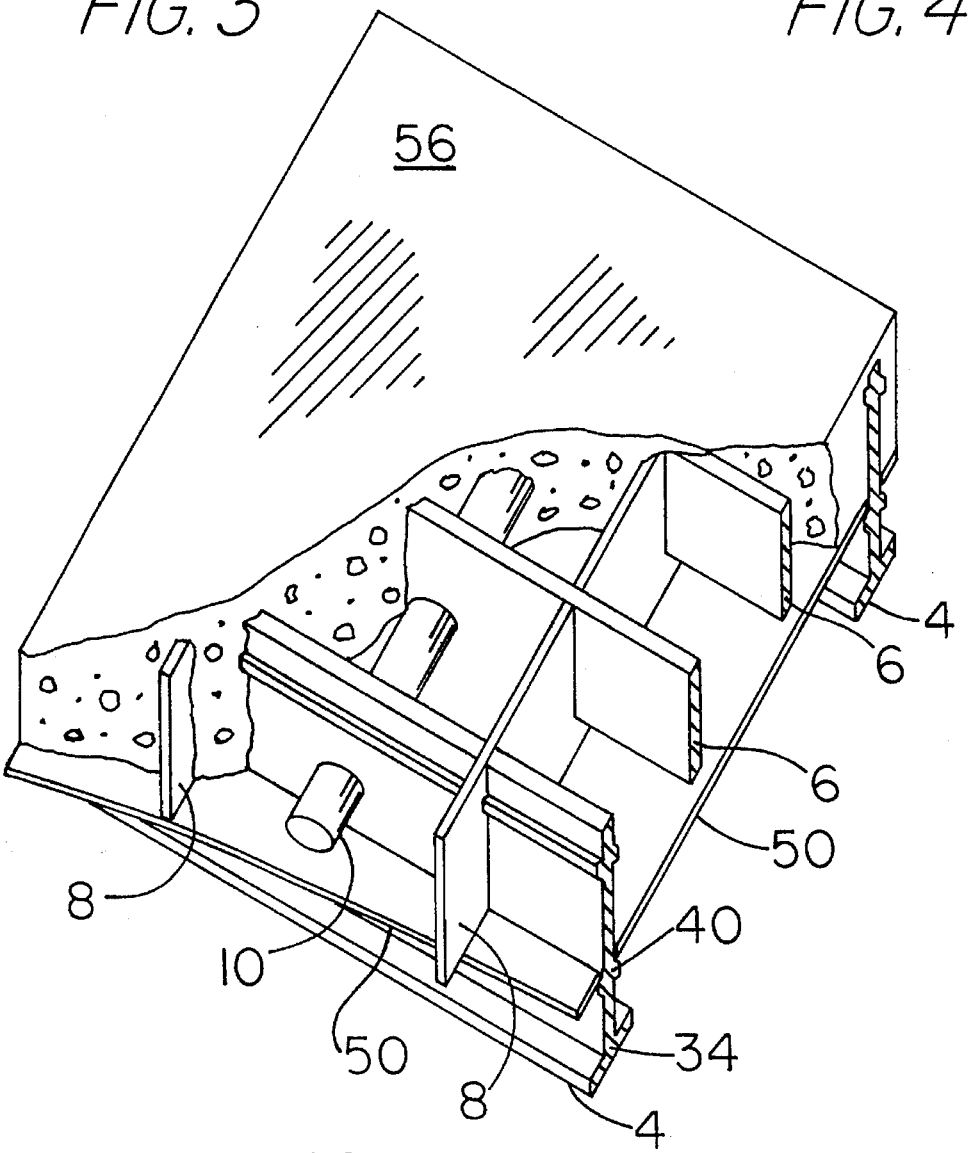
FIG. 5 is a perspective cutaway view of a grating utilizing a deep web with concrete encasing the top portion of the grating.

FIG. 5 is a schematic showing concrete 56 provided in the upper portion of the grating.

Figure 8:
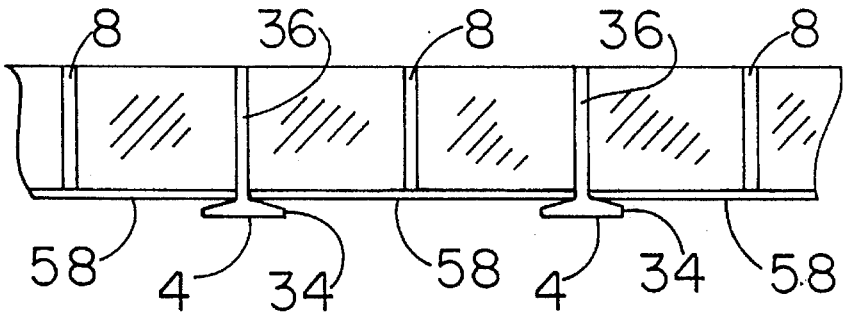
FIG. 8 is an end view along the inverted T-shaped web showing a pan for containing wet concrete.
Figure 9:
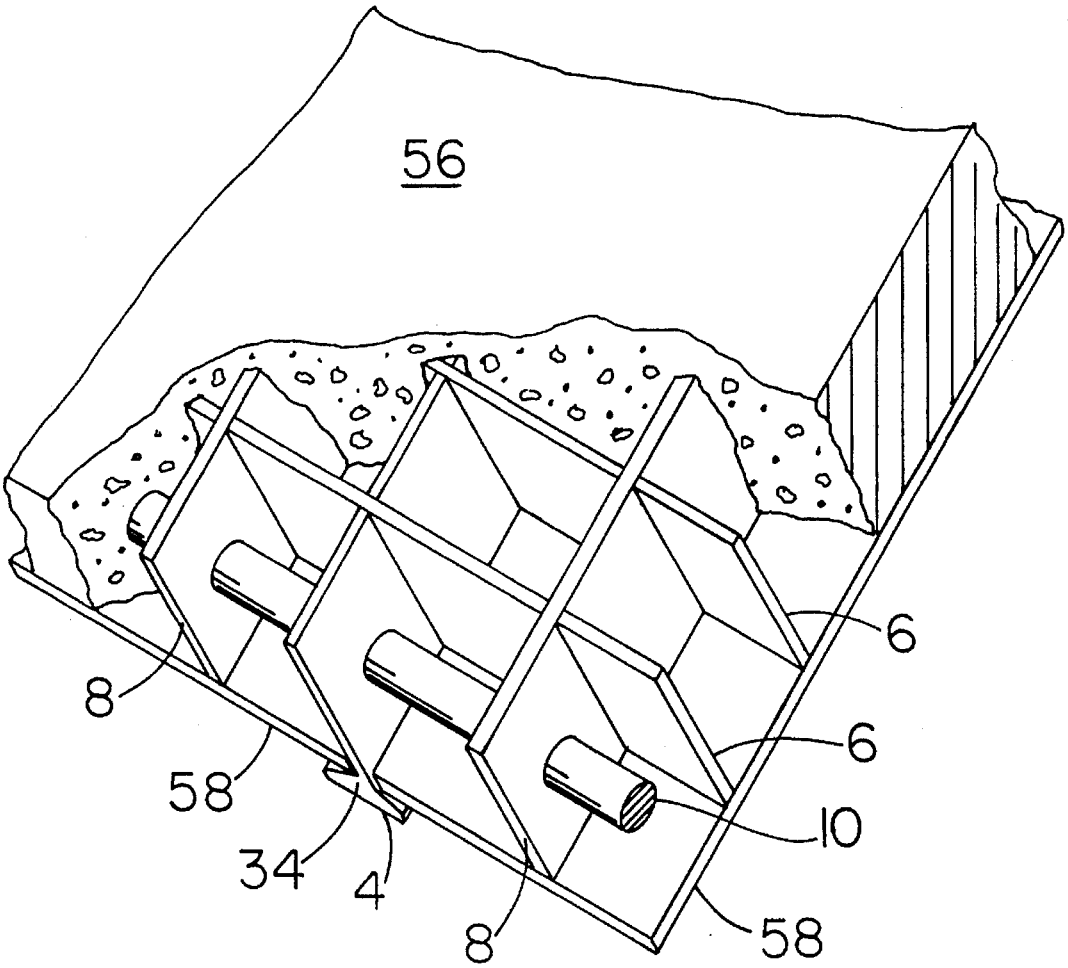
FIG. 9 is a perspective cutaway showing the grating of FIG. 6 encased in concrete.

FIG. 8 is an end view of FIG. 6 showing a pan 58 resting on shoulders of flange 34. Again, preferably pan 58 is provided with serrated edges to prevent movement. In FIG. 9, there is shown a cutaway of the grating described in FIGS. 6, 7 and 8 having concrete provided to encase the grating.

It should be understood that while the grating of the invention has been shown encasing a top portion of the grating (FIG. 5) or all of the grating such as in FIG. 9, the concrete can extend above and below the grating, if desired. That is, the grating can be substantially encapsulated with concrete.

For many applications, rod 10 is preferred to be formed from a solid bar such as a metal bar. However, when the grating in accordance with the invention is used for floors for buildings such as mall floors or is used for concrete encased bridge decks, rod 10 may be a hollow member or pipe connected at the ends so as to form a continuous pipe. Heating liquid can be passed through the pipe for purposes of heating the building.

While the invention has been described with respect to a grating employing a three-bar system and a locking rod, the invention contemplates grating fabricated using two rails such as the primary load bearing bars and secondary load bearing bars. When the grating is fabricated using two rails, then locking rod 10 is inserted through both rails in a diagonal direction.

Further, while the invention has been depicted showing primary load bearing bars having flanges, the invention contemplates gratings fabricated using plain bars for all three load-bearing bars; and in certain gratings, the three bars can have the same dimensions.

The gratings of the invention can be fabricated from metals such as steels, carbon steel, stainless steels and aluminum alloys or from plastics such as fiberglass-reinforced plastics.

In the present invention, if steel bars are used, they may be galvanized prior to assembly or after assembly. If galvanized before assembly, touch up may have to be used to cover scratches resulting from assembly. Further, in the present invention, the slots should be dimensioned to provide for a snug fit to minimize collection of debris such as salts that cause corrosion, particularly in open gratings.

It will be seen that gratings in accordance with the present invention overcome the disadvantages of welded gratings referred to earlier. However, even though welds can be applied to the grating of the present invention, welding is believed to be more detrimental than advantageous. While the invention has been described in terms of preferred embodiments, the claims appended hereto are intended to encompass other embodiments which fall within the spirit of the invention.

What is claimed is:

1. A weldless grating comprising:

(a) a plurality of longitudinally extending primary load bearing members having a top portion and a bottom portion having a plurality of spaced-apart slots therein extending downwardly through the top portion, the slots in each of said primary load bearing members being aligned with the slots in adjacent primary load bearing members;

(b) a plurality of secondary load bearing members having a top portion, the secondary load bearing members positioned in the aligned slots in the primary load bearing members, the secondary load bearing members provided with slots extending downwardly through the top portion and located between said primary load bearing members;

(c) a plurality of tertiary load bearing members positioned in the slots in the secondary load bearing members; and (d) a rod extending through said tertiary load bearing members and said primary load bearing members locking said tertiary load bearing members in the slots in said secondary load bearing members and locking said secondary load bearing members in the slots in said primary load bearing members to form said weldless grating.

2. The grating in accordance with claim 1 wherein each of said secondary load bearing members has a secondary bottom slot at the points of intersection with said primary load bearing members, the bottom slot fitting snugly over the primary load bearing members.

3. The grating in accordance with claim 1 wherein each of said tertiary load bearing members has a tertiary bottom slot at the point of intersection with said secondary load bearing members, the tertiary bottom slot fitting snugly over said secondary load bearing members.

4. The grating in accordance with claim 1 wherein said primary load bearing members and secondary load bearing members have a generally rectangular cross section.

5. The grating in accordance with claim 1 wherein said primary load bearing members are positioned substantially parallel to each other, said secondary load bearing members are positioned transverse to said primary load bearing members and said tertiary load bearing members are positioned substantially parallel to said primary load bearing members.

6. The grating in accordance with claim 1 wherein said rod extend substantially parallel to said secondary load bearing members.

7. The grating in accordance with claim 1 wherein at least one of said secondary or tertiary load bearing members is formed to provide a repeating pattern on said grating surface.

8. A weldless metal grating comprising:

(a) a plurality of substantially parallel, longitudinally extending primary load bearing members having a top portion and a bottom portion having a plurality of spaced-apart slots therein extending downwardly through the top portion, the slots in each of said primary load bearing members being aligned with the slots in adjacent primary load bearing members;

(b) a plurality of secondary load bearing members having secondary bottom slots positioned in alignment with the aligned slots in the primary load bearing members, the secondary load bearing members provided with top slots extending downwardly through the top portion and located between said primary load bearing members;

(c) a plurality of tertiary load bearing members having tertiary bottom slots positioned in alignment with the top slots in the secondary load bearing members; and (d) a rod extending through said tertiary load bearing members and said primary load bearing members locking said tertiary load bearing members in the slots in said secondary load bearing members and locking said secondary load bearing members in the slots in said primary load bearing members to form said weldless metal grating.

9. The grating in accordance with claim 8 wherein the members comprise steel members.

10. The grating in accordance with claim 8 wherein the members comprise an aluminum alloy member.

11. The grating in accordance with claim 8 wherein the members are substantially rectangular shaped in cross section.

12. The grating in accordance with claim 8 wherein the primary load bearing members have a flange located at said bottom portion projecting towards adjacent primary load bearing members and a pan positioned between said primary load bearing members and resting on said flange to provide a bottom on said grating to contain wet concrete.

13. The grating in accordance with claim 8 wherein the rod is circular in cross section.

14. The grating in accordance with claim 8 wherein the members are placed in said slots to provide a planar surface.

15. The grating in accordance with claim 8 wherein said secondary load bearing members are positioned substantially parallel to each other and positioned substantially at right angles across said primary load bearing members and said tertiary load bearing members are positioned substantially parallel to said primary load bearing members.

16. The grating in accordance with claim 8 wherein said rod extends substantially parallel to said secondary load bearing members.

17. A concrete module comprising a weldless metal grating at least partially encapsulated in a body of concrete, the weldless metal grating comprising:

(a) a plurality of longitudinally extending primary load bearing members having a top portion and a bottom portion having a plurality of spaced-apart slots therein extending downwardly through the top portion, the slots in each of said primary load bearing members being aligned with the slots in adjacent primary load bearing members;

(b) a plurality of secondary load bearing members having a top portion, the secondary load bearing members positioned in the aligned slots in the primary load bearing members, the secondary load bearing members provided with slots extending downwardly through the top portion and located between said primary load bearing members;

(c) a plurality of tertiary load bearing members positioned in the slots in the secondary load bearing members; and (d) a rod extending through said tertiary load bearing members and said primary load bearing members locking said tertiary load bearing members in the slots in said secondary load bearing members and locking said secondary load bearing members in the slots in said primary load bearing members to form said weldless metal grating.

18. The module in accordance with claim 17 wherein said module is a bridge deck of bridge ramp module.

19. A concrete module comprising a metal grating at least partially encapsulated in a body of concrete, the metal grating comprising:

(a) a plurality of substantially parallel, longitudinally extending primary load bearing members having a top portion and a bottom portion having a plurality of spaced-apart slots therein extending downwardly through the top portion, the slots in each of said primary load bearing members being aligned with the slots in adjacent primary load bearing members;

(b) a plurality of secondary load bearing members having secondary bottom slots positioned in alignment with the aligned slots in the primary load bearing members, the secondary load bearing members provided with top slots extending downwardly through the top portion and located between said primary load bearing members;

(c) a plurality of tertiary load bearing members having tertiary bottom slots positioned in alignment with the top slots in the secondary load bearing members; and (d) a rod extending through said tertiary load bearing members and said primary load bearing members locking said tertiary load bearing members in the slots in said secondary load bearing members and locking said secondary load bearing members in the slots in said primary load bearing members to form said grating.

20. The grating in accordance with claim 19 wherein said secondary load bearing members are positioned substantially parallel to each other and positioned substantially at right angles across said primary load bearing members and said tertiary load bearing members are positioned substantially parallel to said primary load bearing members.

* * * * *